US005575941A

United States Patent [19]

Johnson

[11] Patent Number: 5,575,941

[45] Date of Patent: Nov. 19, 1996

[54] CARTRIDGE HEATER

[76] Inventor: J. Evan Johnson, 11881 Thornhill Rd., Eden Prairie, Minn. 55344

[21] Appl. No.: 299,153

[22] Filed: Aug. 31, 1994

[51] Int. Cl.[6] ..... H05B 3/44; H01C 1/02

[52] U.S. Cl. ..... 219/544; 219/546; 338/230; 338/238; 338/273

[58] Field of Search ..... 219/544, 546, 219/549, 523; 338/243, 230, 273, 275–276, 238

[56] References Cited

U.S. PATENT DOCUMENTS

| | | | |
|---|---|---|---|
| 3,340,382 | 9/1967 | Lennox | 219/544 |
| 3,678,249 | 7/1972 | Lennox | 219/544 |
| 3,920,963 | 11/1975 | Beasley et al. | 219/544 |
| 3,927,301 | 12/1975 | Heuel et al. | 219/544 |
| 3,982,099 | 9/1976 | Churchill | 219/544 |
| 4,125,761 | 11/1978 | Churchill | 219/544 |
| 5,148,594 | 9/1992 | Gellert | 219/544 |

OTHER PUBLICATIONS

Hotset Corporation catalog—pp. 2–1–2–10.
Tempco Electric Heater Corporation catalog, #84, pp. 1–24.
Watlow catalog, PC9091; pp. i–v and 1–22.

*Primary Examiner*—Teresa J. Walberg
*Assistant Examiner*—Sam Paik
*Attorney, Agent, or Firm*—Palmatier, Sjoquist & Helget

[57] ABSTRACT

The cartridge heater disclosed has a coiled wire heater element with connected lead conductor wires contained within a metallic tubular sheath. Electrically insulative material insulates and supports the heater element and lead conductor wires within said sheath. The tubular enclosure has one or more folds to define parallel longitudinal heater segments containing the heater element. An outer metallic casing surrounds the heater segments defining a body portion. Lead wires comprised of the metallic sheath and the lead conductor wires extend from the body portion.

15 Claims, 3 Drawing Sheets

CARTRIDGE HEATER

The present invention relates to electric heaters. More particularly, it relates to cartridge heaters such as used in plastic injection molding equipment.

BACKGROUND OF THE INVENTION

Many industrial processes utilize electric heaters to provide localized heating of tools, equipment, or the work product. For example, the injection molding process requires heaters to melt and maintain the fluidity of the thermoplastic injection material. In such a process, it is often necessary to provide supplemental heat in critical areas either at an injection nozzle or in runners that lead to mold cavities. One type of heater that is often used is industrial applications, including the plastic injection molding industry, is a cartridge heater. Such cartridges heaters are typically inserted into bores appropriately located on the processing equipment such as thermoplastic molding equipment. In plastic molding applications the cartridge heater temperatures can exceed 600°–700° F.

A typical prior art cartridge heater is shown in FIG. 1 and is generally designated by the numeral 10.

Cartridge heaters comprise a body portion 12 generally configured as an elongate cylinder with lead wires 13, 14 extending from one end 15 of the body portion 12. The body portion 12 is typically ⅛" in diameter or greater. Caps or plugs 16, 17 enclose the ends of the cartridge heater.

The body portion 12 of conventional cartridge heaters comprise a single heater core 18 with a single metallic sheath 20 encasing the core 18. The core 18 has a ceramic coil base 19 on which is wound a heater element 21. The heater element 21 is surrounded by dielectric material 22 separating the heater element 21 from the sheath 20. Heat generated by the heater element 21 is transferred through the dielectric material 22 to the sheath 20. Typically, the lead wires 14, 16 would each comprise a conductor wire 23 and a flexible nonmetallic sheath or sleeve 24 extending from the end 15 of the body portion 12 out of a plug 25 fixed in the metallic sheath 20. The nonmetallic sleeves 24 are often a glass silk or a silicone fiberglass material which provides a flexible insulating sleeve over the lead conductors 21. Such sleeves 24 generally have a temperature tolerance of under 500° F and require a mechanical connection 26 to the body portion 12. With such sleeves 24, the temperature of the cartridge, especially at the lead wire connection end, must be limited to prevent degradation of the lead wire sleeve 24. This can result in a dead or unheated zone at the lead wire end 15 of the body portion. Moreover, the mechanical connections 26 often lack sufficient mechanical support and the leads often break or fail.

Furthermore, the flexible lead wire emerging from the rigid body portion 12 creates an area highly susceptible to bending and failure at the connection or transition 27 between the lead conductor wire and the body portion. This is a common location of lead failure.

The mechanical connection 26 between the lead wires 14, 16 and the body portion 12 also provide routes for entry of contaminants. Similarly, the engagement 27 between the caps or plugs and the metallic sheath 20 may provide a contamination route. Conventional cartridge heaters have significant problems with failure due to contamination. The contaminants may come from such sources as lubricants, cleaning solvents, plastic materials, or fumes. Wherever the cartridge has seams, seals, or connections on the body portion or the lead wires, the opportunity for contamination exists. Any contamination of the dielectric material or the heater element within the cartridge can cause instantaneous failure of the cartridge heater. This type of failure can be highly destructive due in part to the single sheath construction of conventional cartridge heaters. Said failures may weld the cartridge heater to the host equipment and damage the host equipment causing extended break down periods and difficulty in replacing the destroyed cartridge.

The above difficulties, especially the difficulties in attaching lead wires to the body portions, has limited the reduction in diameter of such cartridge heaters.

In an attempt to remedy mechanical support problems and contamination problems, additional metallic fittings or support members, not shown, have been utilized at the lead wire connections to the body portion for support and/or sealing of the leads. These fittings have not proven to be totally satisfactory in sealing out contaminants and in supporting the lead wires and are not practical in smaller diameter heaters. The fitting or support members also add significant cost to the price of the cartridge heater.

Particular applications of cartridge heaters frequently require nonuniform heat distribution along the length of the cartridge. For example, a specific application may need concentrated heat production at the ends of the cartridge as opposed to concentrated heat production at only the mid-portion of the cartridge. This is difficult or impossible to accomplish in conventional cartridge heaters which have the heater coil extending only longitudinally within the cartridge with caps or plugs between the heater element and the ends of the body portion.

SUMMARY OF THE INVENTION

The cartridge heater disclosed has a coiled wire heater element with connected lead conductor wires contained within a metallic tubular sheath. Electrically insulative material insulates and supports the heater element and lead conductor wires within said sheath. The tubular enclosure has one or more folds to define parallel longitudinal heater segments containing the heater element. An outer metallic casing surrounds the heater segments defining a body portion. Lead wires comprised of the metallic sheath and the lead conductor wires extend from the body portion.

An object and advantage of the invention is that, in the preferred embodiment, the heater element, the dielectric material, and the lead conductor wires are effectively enclosed without seams, welds, connections or seals throughout the body portion of the cartridge and within the lead wires adjacent to the body portion. The lack of seams, welds, connections, or seals effectively isolate the heater elements and insulative material from any potential contaminants.

The use of more than one heater segment allows a greater overall length of heater element wire to be used for a particular size cartridge. The greater length of wire thus allows a larger diameter heater wire to be used for the same power output. Larger diameter wire is preferable in that it is more reliable, is easier to work with during the heater fabrication, is stronger, that is less likely to break during handling, and is less likely to "burn out".

The use of a greater length of wire in the same size cartridge permits greater heat production, that is, greater power capacity, from a specific size cartridge.

A further object and advantage of the invention is that the use of more than one longitudinal heater element segment with each element having a metal sheath conductive to the exterior of the cartridge allows more efficient heat transfer from each portion of longitudinal heater element wire to the exterior of the cartridge to the object to be heated. The heat generated by the individual longitudinal coils is more efficiently transferred away from the heater elements resulting in more efficient operation and longer life of the cartridge heater.

An additional object and advantage of the invention is that a much more secure and reliable lead extends from the cartridge body. The invention features lead wires that are comprised of end portion of the metallic sheath which encloses the heater element wires. The end portions extend from the body portion and contain lead conductor wires which are fused to the heater element wire within the cartridge body. This compares to the conventional arrangement of a distinct lead wire sheath with a mechanical fastening of the sheath to the end of the body portion. Thus, the instant invention eliminates the fragile portion of the lead wire at the end of the body portion. The lead wire configuration of the instant invention allows cartridge heaters to be more readily manufactured in smaller diameters.

An additional advantage and object of the invention is that no additional or supplemental fittings, support members, or seals are necessary at the juncture of the lead wires to the body portion.

An additional object and advantage of the invention is that it may be relatively easily and inexpensively manufactured as compared to prior art cartridges.

DETAILED DESCRIPTION OF THE PREFERRED EMBODIMENTS

Figure 1:
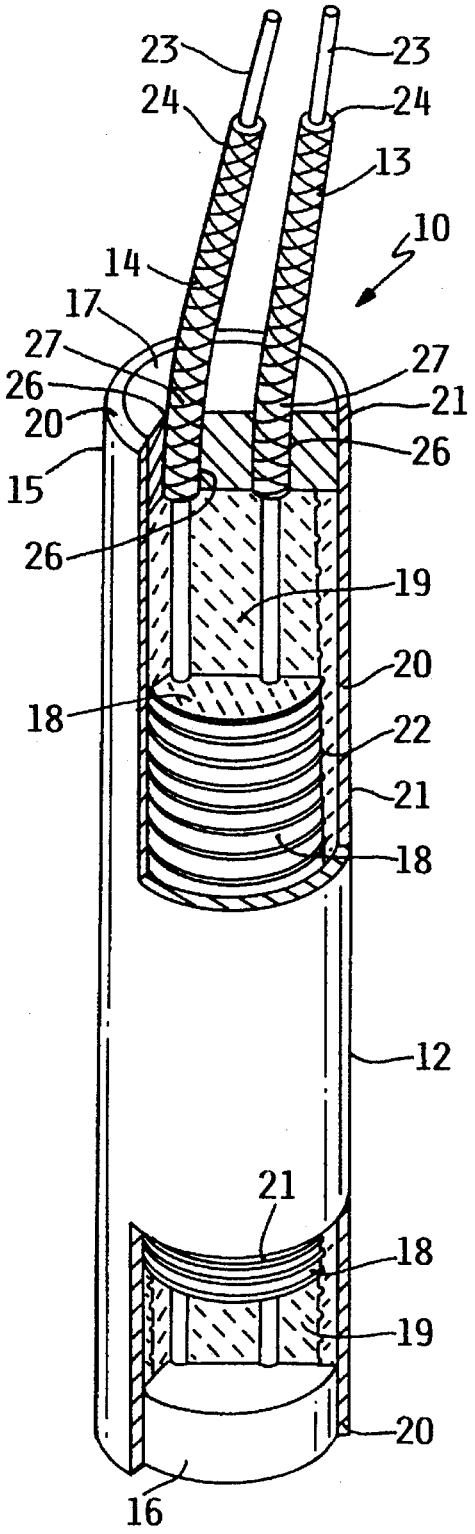
FIG. 1 (PRIOR ART)
FIG. 1 shows a perspective view of a prior art cartridge heater.
Figure 2:
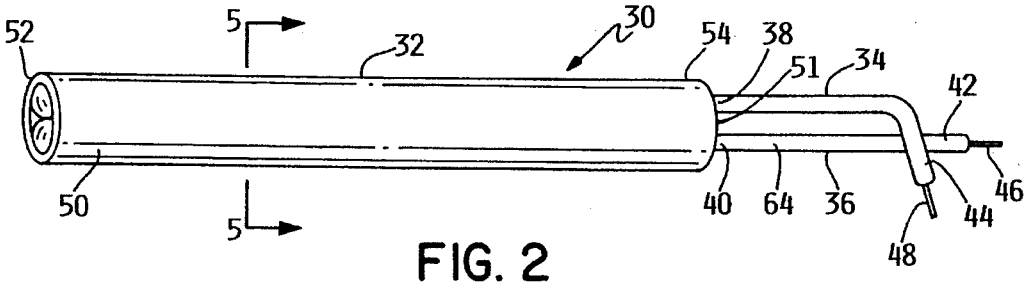
FIG. 2 shows a perspective view of a cartridge heater which embodies the invention.

Referring to FIG. 2, a preferred embodiment of the invention is shown and is generally designated by the numeral 30. The cartridge heater 30 is comprised of a body portion 32 and lead portions or lead wires 34, 36. The lead portions 34, 36 have proximal ends 38, 40 and distal ends 42, 44. Lead conductors 46, 48 extend through the lead portions 34, 36 and out the distal ends 42, 44. The body portion 32 has an outer sleeve or casing 50,with an open end 50 tip or first end 52, and a second end 54.

Figure 3:
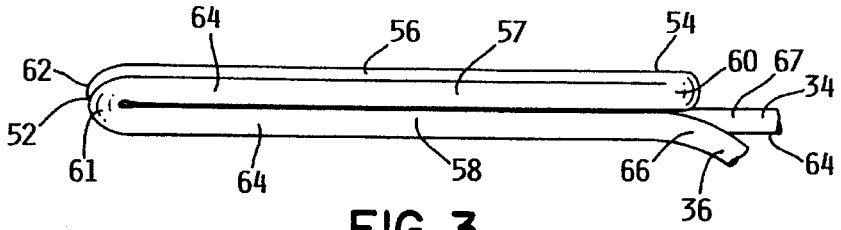
FIG. 3 shows a perspective view of the cartridge heater without the casing showing the separate heater segments.
Figure 5:
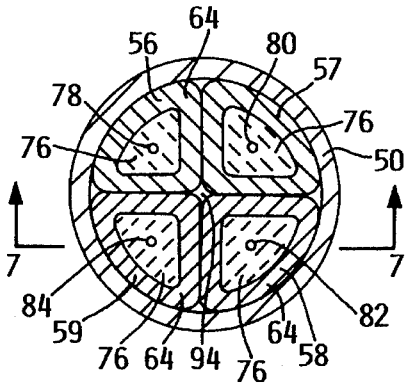
FIG. 5 shows a cross sectional view through the cartridge heater of FIG. 2 at line 5—5.

As best shown in FIGS. 3 and 5, four heater segments 56, 57, 58, 59 extend lengthwise through the casing 50. Three junctions or bends 60, 61, 62 join the heater segments 56, 57, 58, 59. As shown in FIG. 3, the heater segments 56, 57, 58, 59, the bends 60, 61, 62, and lead portions 34, 36 are integral and are formed from a single elongate tubular enclosure 64. The tubular enclosure 64 has an intermediate portion 65 and two end portions 66, 67 and an interior 68. The tubular enclosure end portions 66, 67 are also the outer sleeves of the lead portions 34, 36. The lead portions 34, 36 extend from two heater segments 58, 59. As can be seen best in FIG. 3, the four heater segments 56, 57, 58, 59 are formed by a double folding of the tubular enclosure 64, first at the bend 60 located at the second end 54, and then a second fold creates the bends 61 and 62 at the tip 52.

Figure 4:
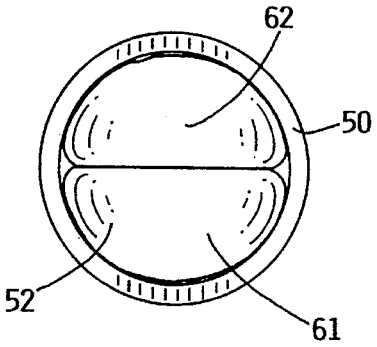
FIG. 4 shows an end view of a cartridge heater.

The heater segments 56, 57, 58, 59 and bends 60, 61, 62 as shown are contained within the casing 50 as best shown in FIG. 4 and the cross section FIG. 5. The cross section of FIG. 5 shows the four heater segments 56, 57, 58, 59 each of which is comprised of the tubular metallic enclosure 64, insulative material 76 and heater segment element wires 78, 80, 82, 84. In the embodiment shown, the heater segment element wires 78, 80, 82, 84 are all integral and together form a coiled single element wire 85 that extends through the heater segments 56, 57, 58, 59 and through the bends 60, 61, 62.

Figure 6:
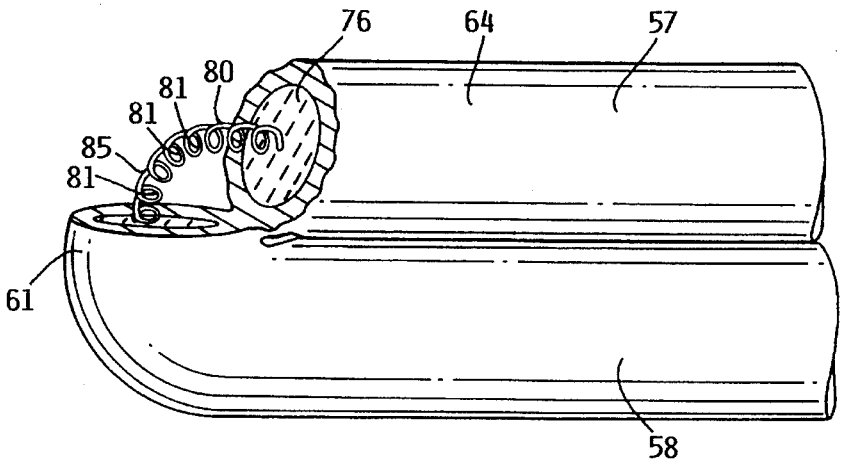
FIG. 6 shows a bend or junction between sequential heater segments with a portion of the bend and a heater segment sheath removed revealing the insulative material and coiled heater element wire.

Referring to FIG. 6, a perspective view of a bend 61 is shown with the heater segments 57, 58 with a portion of the tubular enclosure 64 and insulative material 76 cut away to reveal the heater segment element wire 80 shaped as a coil comprised of a series of loops 81 of the element wire 80.

Figure 7:
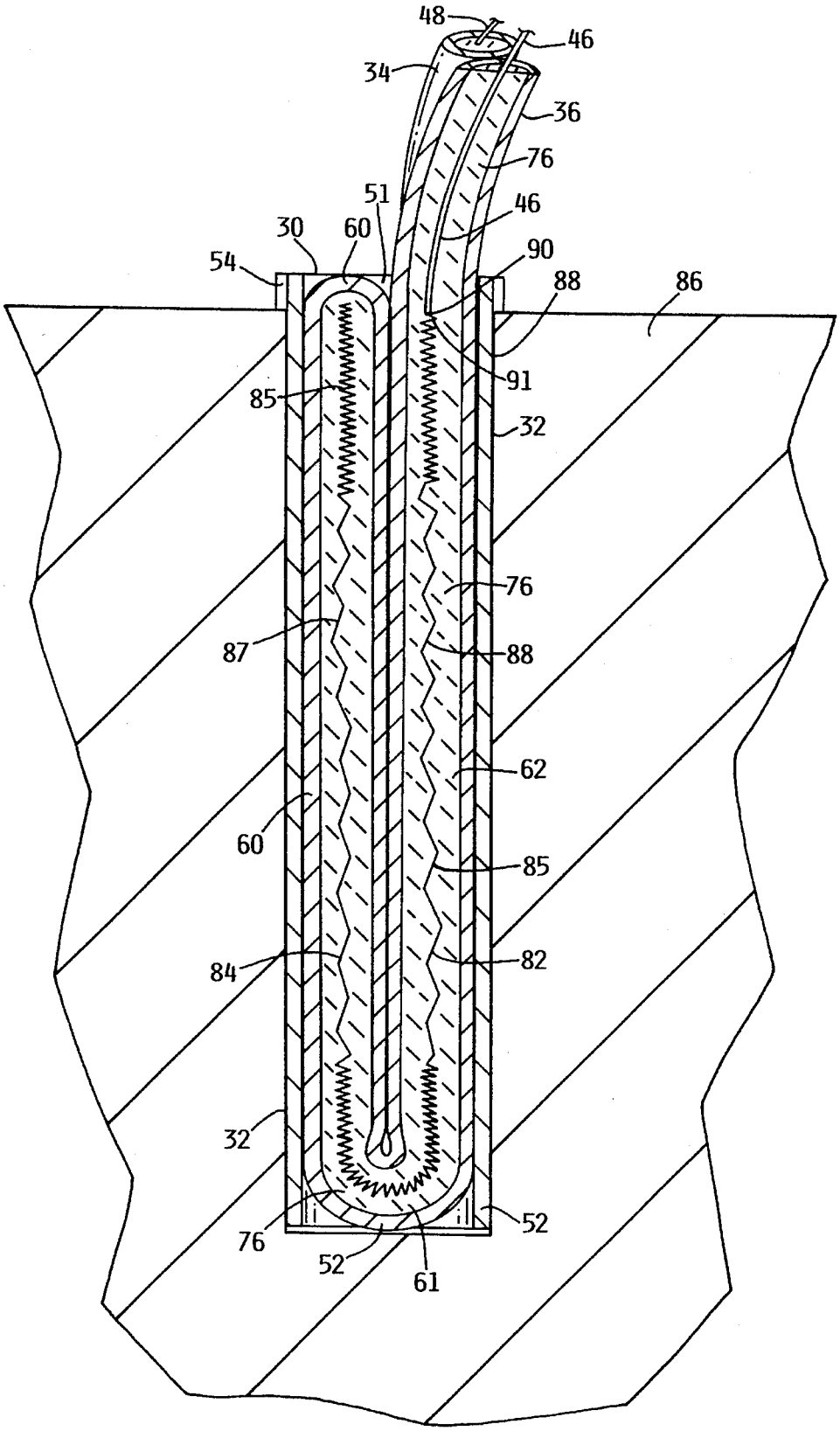
FIG. 7 shows a cross sectional view through the heater of a cartridge heater in place in a piece of equipment. The cross-section through the cartridge heater is as shown in FIG. 5 by line 7—7.

Referring to FIG. 7, a cross sectional view of the cartridge heater 30 in place in a bore 88 in a piece of equipment 86 is shown. The cross sectional of the cartridge heater 30 in this view is taken at approximately line 7—7 of FIG. 5. Heater segments 57, 58 and bends 60, 61 are thus visible in this view. The heater segment element wires 82, 84 are shown with portions 87, 88 of the coiled single element wire 85 stretched or extended to provide for a variable heat distribution pattern along the length of the cartridge heater 30. In the configuration shown in FIG. 7, the heat is concentrated at the tip 52 and the second end 54. The element wire 85 has two ends, one of which is shown on FIG. 7 and is designated by the numeral 91. The element wire ends are attached to the lead conductor wires 46, 48 at connections or transitions, one such connection 90 is shown in FIG. 7. The transition point 90 is located within the body portion 32 of the cartridge heater 30. The insulative material 76 is continuous throughout the length of the tubular metallic enclosure 64. Thus, it extends from the heater segments 56, 57, 58, 59 into the lead portions 34, 36 and supports and electrically insulates the lead wire conductors 46, 48 and heater segment element wires 78, 80, 82, 84.

The electrically insulative material 76 in the preferred embodiment is a ceramic material which may be suitably applied around the heater element wire. Alternate insulative materials include magnesium oxide or other materials that maintain their high dielectric strength at elevated temperatures. The tubular metallic enclosure 64 may be comprised of various nickel or nickel alloys. Said materials maintain sufficient flexibility to be folded into the appropriate configuration. Annealing of the enclosure material 64 may assist in the folding. The metallic casing or outer sleeve 30 may be formed of stainless steel or other suitable metal. The heater wire is suitably a nickel chromium wire and in the preferred embodiment is wound into a suitably sized coil by conventional coil winding means. The lead wire conductors 46, 48 are connected onto the ends of the nickel chromium heater wire 85 such as by brazing to form the connection or transition point 90. The lead wire conductors 46, 48 may be a nickel wire. The coiled heater wire 85 and the lead wire conductors 46, 48 may be inserted into the metallic tubular enclosure 64 with the suitable dielectric material around the heater wire 85. The metallic tubular enclosure 64 with the heater wire 85 and lead wire conductors 46, 48 may be radially compressed to reduce the outer diameter of the metallic tubular enclosure 64 and to compress the insulative material 76 into and around the heater wire 85. The metallic tubular enclosure 64 may then be twice folded to form the four heater segments such as shown in FIG. 3. The heater segments are then inserted into the casing 52 which may be further radially compressed.

Electrical connectors, not shown, may be attached to the conductor lead portions 46, 48 extending from the lead portions 34, 36.

Radially compressing the four heater elements may leave an opening, identified by the numeral 94 in FIG. 5, at the center of the cartridge heater. This opening is suitable for placement of a thermocouple, not shown, and lead wire as are typically utilized in cartridge heaters.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A cartridge heater for injection molding, the cartridge heater comprising:

a) a continuous metallic tubular sheath, the sheath having an interior, two end portions, an intermediate portion between the two end portions, and two ends, one end on each of the end portions, the sheath open at the ends and closed therebetween;

b) a heater element wire with two ends, the heater element wire extending substantially axially through the interior in the intermediate portion of the metallic sheath;

c) two lead conductors respectively connected to each end of the heater element wire, each lead conductor extending substantially axially from an end of the heater element wire through the respective end portions to an end of the metallic sheath;

d) insulative material surrounding and supporting the heater element wire and lead conductors in the intermediate portion and end portions; and e) the intermediate portion of the metallic sheath folded to form a plurality of heater segments positioned in a parallel arrangement, a tubular metallic casing having an open and extending circumerentially around the heater segments, the casing engening the heater segments, the heater segments and casing defining a body portion of the cartridge heater, the two end portions of the metallic sheath with the lead conductors extending away ffrom the body portion at the open end of the casing, the end portions and lead conductors defining lead wires, whereby the insulative material and heater element wire of the body portion are enclosed exclusively within the interior of the metallic sheath; and f) whereby the metallic sheath is continuous and closed rom the ends of the end portions through the lead portions and heater segments.

2. A cartridge heater as claimed in claim 1, wherein the heater element wire extends through the intermediate portion of the metallic sheath and is comprised of a series of loops forming a coil.

3. A cartridge heater as claimed in claim 2, wherein the heater element wire coil has an unextending portion such that the loops in the extended portion have been longitudinally stretched relative to the loops in the un extended portion, whereby greater heat generation is provided at the unextended portions.

4. A cartridge heater as claimed in claim 1, wherein the metallic enclosure is a nickel alloy.

5. A cartridge heater as claimed in claim 3, wherein the metallic sheath is folded at a bend and wherein the extended portion is positioned in the sheath at the bend.

6. A cartridge heater as claimed in claim 1, wherein the insulative material in the body portion is contained entirely within the metallic sheath.

7. A cartridge heater for the injection molding comprising;

a) a heater element wire with two ends;

b) two lead conductors, one connected to each of the two ends of the heater element wire;

c) a continuous tubular metallic sheath, the heater element wire and lead conductors extending through the metallic sheath, the metallic sheath having an intermediate portion and the two end portions, the heater element wire positioned in the enclosure at the intermediate portion and the two lead conductors extending though the two end positions;

d) insulative material supporting and insulating the heater element wire and lead conductors in said metallic sheath; and e) the intermediate portion having at least one fold defining a plurality of heater segments positioned side by side, a metallic casing radially compressed around and contacting the heater segments, the casing having a open end, the two end portion ofthe metallic sheath with the lead conductors extending out said open end and away from said heater segments, the lead conductors and the ends portions defining a pair of lead wires, whereby the metallic sheath is continuous and integral through the lead wires and the heater segments whereby the heater element wire and all insulative material is entirely enclosed in the body portion and lead wires without seams or connections in said body portion or lead wires.

8. A cartridge heater as claimed in claim 7, wherein the heater element wire is coiled with a series of loops.

9. A cartridge heater as claimed in claim 8, wherein the heater as claimed in claim 8, wherein the heater element wire has an unextended portion and an extended portion, the extended portion having the loops stretched longitudinally relative to the unextended portion, whereby greater heat generation is provided at the unextended portion.

10. a cartridge heater as claimed in claim 7, wherein the metallic sheath is a nickel alloy.

11. A cartridge heater as claimed in claim 7, further comprising a casing surrounding the heater segments and wherein the casing is cylindrical.

12. A cartridge nheater comprising:

a) a continuous metallic tubular sheath, the metallic sheath having an intermediate portion and two end portions and two open ends;

b) a heater element wire having two ends;

c) two lead conductor wires electrically connected to the ends of the heater element wire, the heater element wire and the lead wires extending through and insulated from the metallic sheath, the heater element wire positioned in the intermediate portion of the metallic sheath, the lead conductors extending from the intermediate portion through the end portion to the open ends;

d) the intermediate portion folded defining a pair of heater segments, the end portions of the metallic tubular sheath with the lead conductor extending away from the body portion and defining lead wires whereby the insulative material and heater wire are enclosed exclusively within the heater segments and there are no seams, welds or connections in the tubular metallic sheath of the wires and heater segments.

13. A cartridge heater as claimed in the claim 12, wherein the heater element wire and lead wire are insulated from the metallic casing by way of an electrical insulating material extending through the metallic sheath the material separating the heater element wire from the metallic sheath.

14. A cartridge heater as claimed in claim 13, wherein the insulative material is a ceramic material.

15. an electrical heater comprising:

a) a body portion at least two heater segments, each heater segments comprising an outer metallic sheath and a substantially axially positioned inner heater element wire surrounded by insulative material the heater segments all sequentially connected and a tubular casing enclosing and engaging the heater segments; and b) a pair of lead wires, each lead wire having an end and comprising an outer metallic sheath and an inner conductor wire surrounded by insulative material, wherein the inner conductor wires are electrically connected to the inner heater element wires and wherein the outer metallic sheaths of the lead wires, and the outer metallic sheath of the heater segments are formed from a single tubular metallic sheath open only at the ends whereby the metallic sheath of each lead wire are intergral and continuous with the outer metallic sheaths of the heater segments and whereby all the insulative materials in the body portion are contained within the metallic sheath and whereby there are no seams, welds, or breaks in contact with the insulative material.

* * * * *

UNITED STATES PATENT AND TRADEMARK OFFICE

CERTIFICATE OF CORRECTION

PATENT NO. : 5,575,941

DATED : November 19, 1996

INVENTOR(S) : J. Evan Johnson

It is certified that error appears in the above-identified patent and that said Letters Patent is hereby corrected as shown below:

Column 6, line 31, after the second occurrence of the word "end" please delete the word "portion" and insert in its place --portions--.

Column 6, line 34, after the word "the" please delete the word "ends" and insert in its place --end--.

Column 6, line 49, after the number "10." please delete the word "a" and insert in its place --A--.

Column 6, line 54, after the word "cartridge" please delete the word "nheater" and insert in its place --heater--.

Column 6, line 65, after the word "end" please delete the word "portion" and insert in its place --portions--.

Column 7, line 16, after the number "15." please delete the word "an" and insert in its place --A--.

Column 7, line 18, please delete the first word "segments" and insert in its place --segment--.

UNITED STATES PATENT AND TRADEMARK OFFICE
CERTIFICATE OF CORRECTION

PATENT NO. : 5,575,941

DATED : November 19, 1996

INVENTOR(S) : J. Evan Johnson

It is certified that error appears in the above-identified patent and that said Letters Patent is hereby corrected as shown below:

Column 3, line 61, after the word "end" please delete the word "50" and insert in its place --51 a--

Column 4, line 3, after the number "65" please delete the word "and" and insert in its place --,--.

Column 5, line 54, after the word "away" please delete the word "ffrom" and insert in its place --from--.

Column 5, line 67, after the word "has" please insert --an extended portion and--.

Column 5, line 67, after the word "an" please delete the word "unextending" and insert in its place --unextended--.

Column 6, line 2, after the second occurrence of the word "the" please delete the words "un extended" and insert in its place --unextended--.

Column 6, line 13, after the word "molding" please insert --, the heater--.

Column 6, line 31, please delete the first word "a" and insert in its place --an--.

Signed and Sealed this

Twenty-fifth Day of February, 1997

Bruce Lehman

*Attest:*

BRUCE LEHMAN

*Attesting Officer*

*Commissioner of Patents and Trademarks*